United States Patent [19]

Tsuji et al.

[11] Patent Number: 4,661,015

[45] Date of Patent: Apr. 28, 1987

[54] RISING AND FALLING WEIR OF FLEXIBLE MEMBRANE

[75] Inventors: Yoshiomi Tsuji; Hajime Naitoh, both of Osaka, Japan

[73] Assignee: Sumitomo Electric Industries, Ltd, Osaka, Japan

[21] Appl. No.: 707,373

[22] Filed: Mar. 1, 1985

[30] Foreign Application Priority Data

Mar. 6, 1984 [JP] Japan ..... 59-43146

[51] Int. Cl.[4] ..... E02B 7/02

[52] U.S. Cl. ..... 405/115; 405/91

[58] Field of Search ..... 405/115, 91, 107, 87

[56] References Cited

U.S. PATENT DOCUMENTS 3,855,800 12/1974 Ganzinotti ..... 405/91

FOREIGN PATENT DOCUMENTS 3102544 9/1982 Fed. Rep. of Germany ..... 405/115
0069910 4/1983 Japan ..... 405/115
0069911 4/1983 Japan ..... 405/115

*Primary Examiner*—Dennis L. Taylor
*Attorney, Agent, or Firm*—Cushman, Darby and Cushman

[57] ABSTRACT

A flexible membrane-type rising and falling weir is anchored at the curved crest of a concrete structure in a body of water. A drain discharge pipe has an opening positioned at the lowest portion of the interior of the envelope to provide complete discharge of water accumulated so that the weir deflates completely to permit smooth flow of water over it.

3 Claims, 7 Drawing Figures

RISING AND FALLING WEIR OF FLEXIBLE MEMBRANE

BACKGROUND OF THE INVENTION

1. Field of the Invention

The present invention relates in general to a rising and falling weir made of a flexible membrane and, more particularly, to a pneumatically inflatable weir which is equipped with improved drain relieving means.

2. Description of the Prior Art

A rising and falling weir made of a flexible membrane is anchored at a crest of a concrete structure in a body of water to control water flow by inflating the weir to raise it or deflating it to lower it.

The basic structure of an inflatable weir includes an envelope of rubberized fabric or the like attached to a bed portion of the crest. A pressure medium, such as air and/or water, is charged into the envelope to inflate the weir to an upstanding position. The pressure medium is discharged from the envelope to shrink it to a folded position (e.g., Japanese Unexamined Patent Publication Nos. 11702/1965 and 2371/1969).

With reference to FIG. 1, when an inflatable weir according to the prior art is attached to the crest of a high dam made of concrete 1 to obtain high water level damming performance, water 4 accumulates inside of an envelope 2 at the bottom portion thereof, because this bottom portion is located below the level of a water charging/discharging port 3 used to inflate/deflate the envelope 2. Water vapor in the air injected into the envelope 2, via a charging/discharging pipe 5, is cooled by the body of water on which the weir is used. The steam condenses into water 4. As a result, water 4 remains in the envelope 2 when it is deflated. This remaining water 4 prevents the weir from completely shrinking to its folded position on the crest and prevents dammed water from smoothly falling over the crest after deflation of the envelope 2.

In such a conventional weir, since the water charging/discharging port 3 is located above the level of the lowest portion of the envelope 2 which is the bottom of the envelope 2 in its folded position, the remaining water 4 cannot be completely discharged.

SUMMARY OF THE INVENTION

In view of the above-described drawbacks of the prior art, an object of this invention is to provide an improved weir of the flexible membrane type. This invention provides a flexible membrane weir having an opening of a drain discharge pipe located at the lowest portion of an envelope (also known in the art as the "bag") of rubberized fabric to be attached to a bed portion of a crest.

BRIEF DESCRIPTION OF THE DRAWINGS

Other objects, features and advantages of the present invention will become apparent from the following description read in conjunction with the drawings wherein the same reference numerals indicate like or corresponding parts throughout:

FIG. 2 is a schematic cross section of an embodiment wherein a drain pipe is connected with the charging/discharging pipe.

FIG. 3(*a*) is a schematic view of an embodiment wherein the drain pipe is provided independent of the charging/discharging pipe, and FIG. 3(*b*) is a schematic cross section as viewed from the transverse direction of a river on which the weir is positioned.

DETAILED DESCRIPTION OF THE PREFERRED EMBODIMENTS

The drain discharging pipe 6 (also referred to as "drain") feature of the invention will be described with reference to FIGS. 2 and 3. An opening 7 of drain 6 is located at the lowest portion of the envelope 2. Drain 6 is opened to envelope 2 at an opening 7 shown in FIGS. 2 and 3.

Figure 1A:
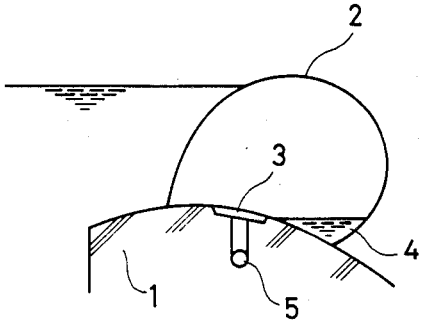
FIG. 1(a) PRIOR ART
FIG. 1 (PRIOR ART) is a schematic cross sectional view of a conventional rising and falling weir attached to a concrete structure, in which FIG. 1(*a*) shows the standing (inflated) position of the weir and FIG. 1(*b*) shows a folded position of the weir.
Figure 1B:
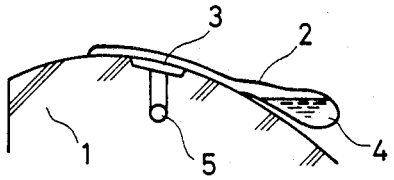
FIG. 1(b) PRIOR ART
Figure 2:
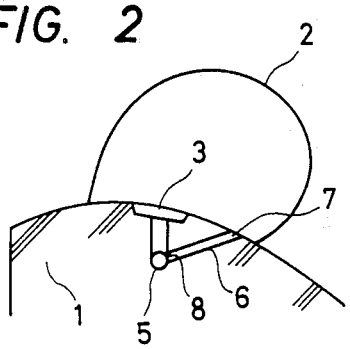
FIGS. 2 and 3 shows a rising and falling weir according to the present invention.

As shown in FIG. 2, drain 6 for discharging water is connected with the charging/discharging pipe 5. The number and size of pipe elements forming drain 6 is dependent upon the width of the river.

A connecting position between the charging/discharging pipe 5 and drain 6 is located below the level of opening 7 of the drain 6 so as to permit a smooth discharge of water from envelope 2.

Figure 3A:
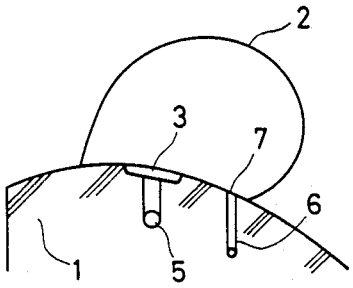
Figure 3B:
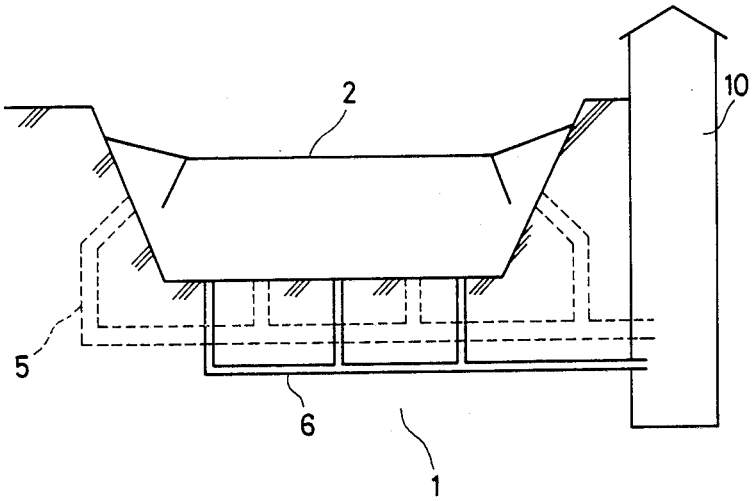

FIG. 3(*a*) shows another pipe arrangement in which drain discharging pipe 6 is independent from the charging/discharging pipe 5. The water in envelope 2 is discharged through the drain discharging pipe 6 when required. The embodiment in FIG. 3(*b*) includes an operation room 10, which is connected to pipes 5 and drain 6.

As described above, in regard to FIG. 3(*a*), opening 7 of the drain discharging pipe 6 is provided in addition to opening 3 of the charging/discharging pipe 5. Opening 7 is positioned at the lowest portion of the envelope 2. As a result, water does not remain in envelope 2 and can smoothly discharge therefrom via opening 7 of pipe 6.

In an embodiment wherein the charging/discharging pipe 5 is also used for the drain 6 and an opening 3 of the pipe 5 is located at the lowest portion of the envelope 2 the drain discharging effect may be degraded. The diameter of the charging/discharging pipe 5 is determined in accordance with the charging/discharging time period of the weir. Generally, this diameter is in a range of 50–150 mmA.

Figure 4:
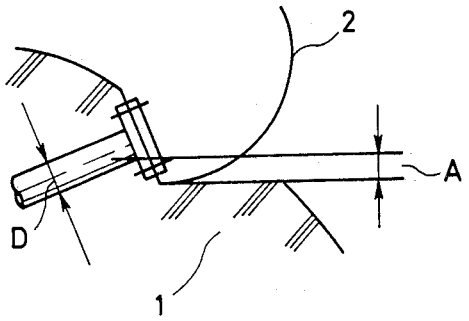
FIGS. 4(*a*) and 4(*b*) are explanatory illustrations showing the drain discharging effect attendant to each of the drain discharging pipes of two embodiments of the present invention.
Figure 4:
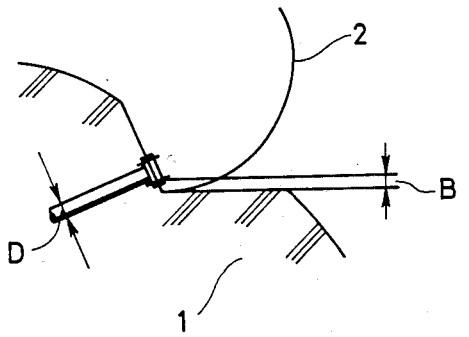

A charging/discharging pipe 5 having a large diameter D requires a large flange to provide the opening as shown in FIG. 4(*a*). As a result, a distance A from the lowest portion of the envelope 2 to the opening 3 is increased. On the other hand, when the pipe 5 has a smaller diameter D as shown in FIG. 4(*b*), a distance B from the lowest portion of the envelope 2 to the opening 3 is smaller than distance A shown in FIG. 4(*a*). Therefore, the drain discharging effect of the embodiment as shown in FIG. 4(*b*) is higher than that of the embodiment as shown in FIG. 4(*a*).

Accordingly, the present invention may include a drain discharging pipe 6 having a smaller diameter compared with that of the charging/discharging pipe 5 and which is provided with an opened end at the lowest portion of the envelope 2.

According to the present invention, the drain 6 is positioned at the lowest portion so that water can be poured out of the envelope 2 smoothly. As a result, the weir can be completely raised upon inflation and lowered upon deflation.

Other embodiments and modifications of the present invention will be apparent to those of ordinary skill in the art having the benefit of the teaching presented in the foregoing description and drawings. It is therefore, to be understood that this invention is not to be unduly limited and such modifications are intended to be included within the scope of the appended claims.

What is claimed is:

1. A rising and falling weir of the flexible membrane type for mounting on a curved top surface of a dam, comprising:

a flexible envelope formed so that it can be anchored at a curved crest of a concrete structure on a body of water;

a fluid charging/discharging pipe having an opening at one end to provide fluid communication with the interior of said flexible envelope for operating it in either an inflated or a deflated position; and at least one drain discharge pipe having an opening at a first end thereof positioned at the lowest portion of the interior of said flexible envelope.

2. A weir according to claim 1, wherein a second end of said drain discharge pipe is connected to said fluid charging/discharging pipe at a position lower than that of said opening of said drain discharge pipe.

3. A weir according to claim 1, wherein said drain discharge pipe is independent of said fluid charging/discharging pipe so that there is no fluid communication therebetween.

* * * * *